US009370264B2

(12) United States Patent
Markee

(10) Patent No.: US 9,370,264 B2
(45) Date of Patent: Jun. 21, 2016

(54) DISPLAY SHELVING FORMED OF CORRUGATED FIBERBOARD

(71) Applicant: Vincent Markee, Hauppauge, NY (US)

(72) Inventor: Vincent Markee, Hauppauge, NY (US)

(73) Assignee: Vincent Markee, Hauppauge, NY (US)

( * ) Notice: Subject to any disclaimer, the term of this patent is extended or adjusted under 35 U.S.C. 154(b) by 103 days.

(21) Appl. No.: 14/200,899

(22) Filed: Mar. 7, 2014

(65) Prior Publication Data

US 2014/0263127 A1 Sep. 18, 2014

Related U.S. Application Data

(60) Provisional application No. 61/794,656, filed on Mar. 15, 2013.

(51) Int. Cl.

| | |
|---|---|
| ***A47F 5/00*** | (2006.01) |
| ***A47G 29/00*** | (2006.01) |
| ***A47F 5/11*** | (2006.01) |
| ***A47B 47/06*** | (2006.01) |
| ***A47B 43/02*** | (2006.01) |
| ***A47B 55/06*** | (2006.01) |

(52) U.S. Cl.

CPC ..... *A47F 5/116* (2013.01); *A47B 43/02* (2013.01); *A47B 47/06* (2013.01); *A47B 55/06* (2013.01); *A47F 5/0043* (2013.01); *Y10T 29/49826* (2015.01)

(58) Field of Classification Search

CPC ..... A47F 5/116; A47F 5/0043; A47F 5/112; A47F 5/114; A47F 5/11; A47F 5/0025; A47F 5/10; A47F 5/108; A47F 5/00; A47F 5/0018; A47B 43/02; A47B 47/06; A47B 55/06; A47B 61/06; A47B 47/00; A47B 47/0066; A47B 47/0075; A47B 55/00; B65D 5/52; Y10T 29/49826

USPC ..... 211/135, 72, 73, 126.16, 193, 195, 186; 248/152, 174, 300; 29/428; 229/116.1; 220/532, 533

See application file for complete search history.

(56) References Cited

U.S. PATENT DOCUMENTS

| | | | | | |
|---|---|---|---|---|---|
| 2,736,475 | A * | 2/1956 | Lehman | A47F 1/00 | 211/85.4 |
| 3,292,796 | A * | 12/1966 | Paige | A47F 5/114 | 211/132.1 |
| 4,618,115 | A * | 10/1986 | Belokin, Jr. | A47F 5/116 | 211/135 |
| 5,048,701 | A * | 9/1991 | Simpson | A47F 5/00 | 211/133.1 |
| 5,458,411 | A * | 10/1995 | Moss | A47F 5/116 | 312/259 |
| 5,564,578 | A * | 10/1996 | Smith | A47F 5/04 | 211/133.1 |
| 6,135,033 | A * | 10/2000 | Deferrari | A47F 5/116 | 108/165 |
| 6,474,483 | B1 * | 11/2002 | Montoya | A47B 47/06 | 211/149 |
| D489,198 | S * | 5/2004 | Mason | D6/680 | |
| 7,252,200 | B1 * | 8/2007 | Hester | A47F 5/116 | 211/126.16 |

(Continued)

*Primary Examiner* — Jennifer E Novosad

(74) *Attorney, Agent, or Firm* — F. Chau & Associates, LLC

(57) ABSTRACT

A shelving unit includes a crossed core unit having four walls formed of folded corrugated fiberboard. The walls are orthogonally arranged with respect to each other and define four quadrants therebetween. Floating shelves are arranged with at least one shelf disposed in each quadrant. Each of the shelves is formed of folded corrugated fiberboard. Each of the shelves is joined to two proximate walls of the crossed core unit. Support tubes are provided. Each support tube is formed of folded corrugated fiberboard and each tube is disposed though one wall of the crossed core and extends inside of two floating shelves that are located in proximate quadrants.

16 Claims, 20 Drawing Sheets

(56) References Cited

U.S. PATENT DOCUMENTS

| | | | | |
|---|---|---|---|---|
| 8,091,715 | B2 * | 1/2012 | Roth | A47B 43/02 211/187 |
| 8,651,297 | B2 * | 2/2014 | Beaty | A47F 5/116 211/135 |
| 2005/0274684 | A1 * | 12/2005 | Swanson | A47B 43/02 211/78 |
| 2008/0030113 | A1 * | 2/2008 | Vail | A47B 43/02 312/259 |
| 2008/0157582 | A1 * | 7/2008 | Bertele | A47B 43/02 297/440.12 |
| 2014/0135193 | A1 * | 5/2014 | Albarran-Torres | A47B 47/06 493/390 |
| 2014/0263127 | A1 * | 9/2014 | Markee | A47F 5/116 211/135 |

* cited by examiner

DISPLAY SHELVING FORMED OF CORRUGATED FIBERBOARD

CROSS-REFERENCE TO RELATED APPLICATION

The present application is based on provisional application Ser. No. 61/794,656, filed Mar. 15, 2013, the entire contents of which are herein incorporated by reference.

TECHNICAL FIELD

The present disclosure relates to display shelving and, more specifically, to display shelving formed of corrugated fiberboard.

DISCUSSION OF THE RELATED ART

Display shelving is commonly used in stores as a means for containing and displaying goods. Often, display shelving is formed from lasting materials such as metal, plastic, wood, etc. Such display shelving must be stocked and periodically restocked with goods as the goods are sold and accordingly significant worker effort is expended on the stocking of shelves.

Often manufacturers and distributers of goods wish to install temporary displays in retail stores and warehouse clubs. This temporary display shelving may come pre-stocked and ready for placement directly within the store or warehouse floor and accordingly, only minimal worker effort is needed to ready the products for sale. These temporary displays may include promotional signage, which may serve to attract the attention of shoppers and promote the product being sold.

However, owing to the structural limitations of temporary display shelving, the arrangement of the display of products within the temporary display shelving may be suboptimal and available visible display space for containing and displaying goods may be inadequate.

SUMMARY

A shelving unit includes a crossed core unit having four walls formed of folded corrugated fiberboard, the four walls orthogonally arranged with respect to each other and defining four quadrants therebetween. A plurality of floating shelves is arranged with at least one of the plurality of floating shelves disposed in each quadrant. Each of the plurality of floating shelves is formed of folded corrugated fiberboard. Each of the plurality of floating shelves is joined to two proximate walls of the crossed core unit. A plurality of support tubes is provided. Each support tube is formed of folded corrugated fiberboard and each tube is disposed though one wall of the crossed core and extends inside of two floating shelves of the plurality of floating shelves that are located in proximate quadrants.

The crossed core unit may be disposed on a base unit formed of folded corrugated fiberboard, the base unit being a rectangular prism or cuboid in shape. The base unit may be disposed on one or more shipping pallets. A cap unit may be formed of a single sheet of corrugated fiberboard and may be disposed on top of the crossed core unit. The cap unit may be substantially cross-shaped.

The plurality of floating shelves may be arranged in at least one plane such that four of the plurality of floating shelves are disposed in each of the at least one plane. The two floating shelves that each of the plurality of support tubes are extended through may be disposed in a common plane of the at least one plane. The at least one plane may include at least two planes and each of the at least two planes includes four floating shelves of the plurality of floating shelves. For each plane of the at least one plane, there may be two support tubes. For each plane of the at least one plane, there may be four support tubes.

Each of the plurality of floating shelves may be joined to the walls of the crossed core unit using an adhesive or tabs and slits. Each of the plurality of support tubes may be disposed through the one wall of the crossed core through a hole formed therein. Each of the plurality of support tubes may have a shape of a rectangular prism or cuboid.

A shelving unit includes a crossed core unit including a first wall formed of folded corrugated fiberboard, a second wall formed of folded corrugated fiberboard extending at a right angle with respect to the first wall, a third wall formed of folded corrugated fiberboard extending at a right angle with respect to the second wall, and a fourth wall formed of folded corrugated fiberboard extending at a right angle with respect to the third wall. A first floating shelf is formed of folded corrugated fiberboard and is disposed between the first and second wall, a second floating shelf formed of folded corrugated fiberboard and disposed between the second and third wall, a third floating shelf formed of folded corrugated fiberboard and disposed between the third and fourth wall, and a fourth floating shelf formed of folded corrugated fiberboard and disposed between the fourth and first wall. Each of the first, second, third and fourth floating shelves is disposed within a first plane. A first support tube is formed of folded corrugated fiberboard and is disposed through a first hole in the first wall and extends inside of the first and fourth floating shelves. A second support tube is formed of folded corrugated fiberboard and is disposed through a first hole in the third wall and extends inside of the second and third floating shelves.

A third support tube may be formed of folded corrugated fiberboard and may be disposed through a first hole in the second wall and extending inside of the first and second floating shelves. A fourth support tube may be formed of folded corrugated fiberboard and may be disposed through a first hole in the fourth wall and extending inside of the third and fourth floating shelves.

A fifth floating shelf may be formed of folded corrugated fiberboard and may be disposed between the first and second wall. A sixth floating shelf may be formed of folded corrugated fiberboard and may be disposed between the second and third wall. A seventh floating shelf may be formed of folded corrugated fiberboard and may be disposed between the third and fourth wall. An eighth floating shelf may be formed of folded corrugated fiberboard and may be disposed between the fourth and first wall. Each of the fifth, sixth, seventh and eighth floating shelves may be disposed within a second plane. A third support tube may be formed of folded corrugated fiberboard and may be disposed through a second hole in the first wall and may extend inside of the fifth and sixth floating shelves. A fourth support tube may be formed of folded corrugated fiberboard and may be disposed through a second hole in the third wall and may extend inside of the sixth and seventh floating shelves.

The first and third walls may be arranged end-to-end with respect to each other and the second and fourth walls may each be arranged to meet both the first and third walls.

A cap unit may be formed of a single sheet of corrugated fiberboard that covers each of the tops of the first, second, third, and fourth walls. Each of the first and second support tubes may have a shape of a rectangular prism or cuboid.

A method for transporting and displaying products includes assembling a shelving unit. The shelving unit includes a crossed core unit including four walls formed of folded corrugated fiberboard. The four walls are orthogonally arranged with respect to each other and defining four quadrants therebetween. A plurality of floating shelves is included with at least one of the plurality of floating shelves disposed in each quadrant. Each of the plurality of floating shelves is formed of folded corrugated fiberboard. Each of the plurality of floating shelves is joined to two proximate walls of the crossed core unit. A plurality of support tubes is provided. Each of the tubes is formed of folded corrugated fiberboard and each tube is disposed though one wall of the crossed core and extends inside of two floating shelves of the plurality of floating shelves that are located in proximate quadrants. A plurality of products is arranged on the plurality of floating shelves. The shelving unit is shipped with products arranged therein to a retail showroom for display of the plurality of products within the shelving unit.

Assembling the shelving unit may include joining the plurality of floating shelves to the two proximate walls of the crossed core unit using tabs and slits or an adhesive.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF THE DRAWINGS

Figure 1:
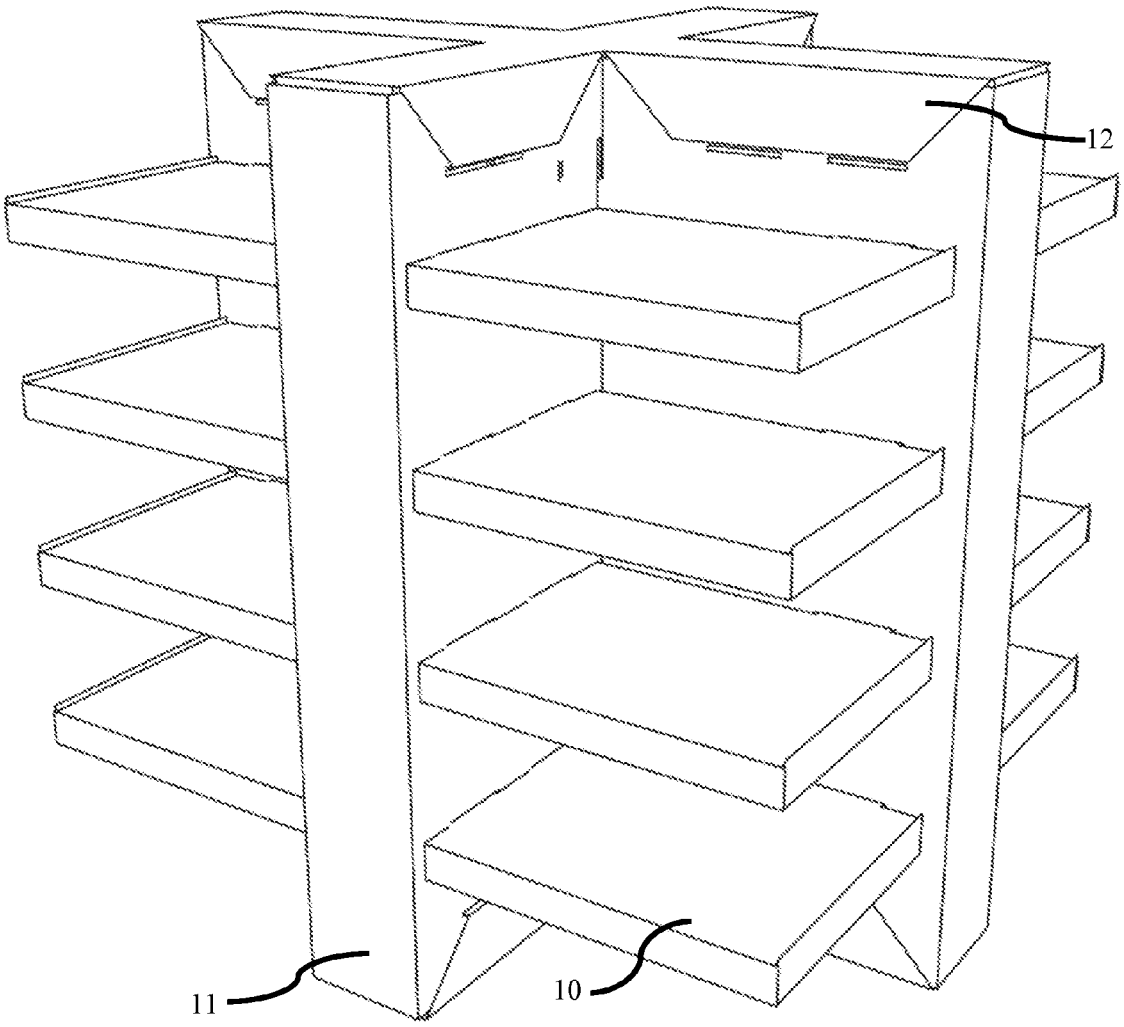
FIG. 1 is a perspective view illustrating a display shelving in accordance with exemplary embodiments of the present invention.

In describing exemplary embodiments of the present disclosure illustrated in the drawings, specific terminology is employed for sake of clarity. However, the present disclosure is not intended to be limited to the specific terminology so selected, and it is to be understood that each specific element includes all technical equivalents which operate in a similar manner.

Exemplary embodiments of the present invention pertain to display shelving that is primarily formed of corrugated fiberboard such as corrugated paper or other forms of cardboard. The display shelving may be adorned with promotional signage and may contain and display products. The products may be packaged into the display shelving prior to the sending of the products to the retail facilities and mounted upon a shipping pallet for easy transport and movement via forklift. Accordingly, exemplary embodiments of the present invention may act as both transportation packaging and display apparatus.

Exemplary embodiments of the present invention may include three primary sections, a base for supporting the display shelving, a crossed core for providing structural integrity, and a plurality of floating shelves attached to the crossed core. Each of these sections may be formed entirely of corrugated paperboard such as cardboard.

The base may act as support for the display shelving and may be a rectangular box. The rectangular box may itself provide support for the display shelving, however, according to other exemplary embodiments of the present invention, the rectangular box may serve as covering for one or more shipping pallets that are stacked therein. The shipping pallets may be conventional wooden pallets and may be easily lifted by a forklift. Alternatively, the pallets may be constructed of metal or plastic. Indeed the particular construction of the pallet is not limited as exemplary embodiments of the present invention may be easily used with any available pallets. The pallets may be reused after the display shelving is deconstructed, after all products have been sold.

The crossed core may include four walls arranged at right angles such that it has a cross section in the shape of a plus sign (+). The crossed core may be substantially hollow and formed of a single sheet of corrugated paperboard bent into shape. Alternatively, the crossed core may be formed by interlocking multiple sections using tabs and slits, adhesives, or a combination of both. The crossed core may additionally include a cap at the top for added structural integrity. The cap may also be comprised of corrugated paperboard and may be in the form of a plus sign with tabs that bend down to affix to the single sheet. The crossed core may be engaged into the base by interlocking tabs, adhesives or a combination of both means.

As described above, the crossed core may include four protruding walls that form right angles with respect to each other. Thus, four quadrants are defined by the crossed core. In each quadrant, one or more floating shelves may be arranged. The floating shelves are said to be floating as they attach only to the crossed core and the bottoms of each shelf is not independently supported. The floating shelves may each attach to two protruding walls of the crossed core. Each floating shelf may be shaped as a square, a rectangle, a triangle, or a quarter-circle. However, regardless of the shape of the shelf, it may have a right angle corner that fits into an empty quadrant. Each floating shelf may be affixed to two and only orthogonal walls of the crossed core. Therefore, each floating shelf is entirely located within a single quadrant.

There may be multiple floating shelves vertically stacked and affixed in each quadrant and space may be left between shelves so that a desired product may be neatly arranged therein. Each quadrant may also include one non-floating shelf that sits directly on the base. Each shelf may either be flat, may be a bin, or may include multiple cutouts for holding products therein.

Exemplary embodiments of the present invention may provide enhanced structural support for each of the floating shelves by the use of one or more a support tubes. Each support tube may be formed as an elongated hollow box that may be substantially equal in length to two floating shelves plus the thickness of one wall of the crossed core. Accordingly, a support tube may be disposed through a cutout in a wall of the crossed core. As will be described in greater detail below, of the four walls of the crossed core, two opposite walls that are aligned in a common direction (e.g. projecting out 180 degrees from each other) may each be disposed with holes for receiving support tubes. The support tubes may then be inserted through each hole and the floating shelves may be disposed over the support tubes such that each floating shelf may have at least a single support tube extended therethrough. Accordingly, in addition to obtaining structural support from the connection of the floating shelves to the walls of the crossed core, each floating shelf obtains additional structural support from at least one support tube which extends therethrough. Moreover, by providing each support tube through two floating shelves, the weight carried by one floating shelf may serve to support the weight carried by a matched floating shelf, wherein the matched floating shelf is defined as a floating shelf sharing the same support tube.

FIG. 1 is a perspective view illustrating a display shelving in accordance with exemplary embodiments of the present invention. Each portion of the display shelving may be formed from substantially flat corrugated paper (e.g. cardboard) with each section being assembled by folding that section up into the desired shape. The display shelving may be disposed on a pallet and may be pre-configured with products to be displayed prior to shipping to the store or warehouse where the products displayed therein may be viewed and purchased. After all of the products are purchased, the display shelving may be dismantled and recycled. The display shelving in accordance with exemplary embodiments of the present invention may include a base (not shown) that may rest on a pallet (not shown). A crossed core 11 including four walls may be disposed on the base. Floating shelves 10 may be disposed between proximate walls of the crossed core 11. The shelves 10 are said to be floating because they connect to the crossed core 11 only at two sides and are not supported from below. A cap is disposed on top of the crossed core 11 to provide additional structural integrity and to present a more finished appearance.

Figure 2:
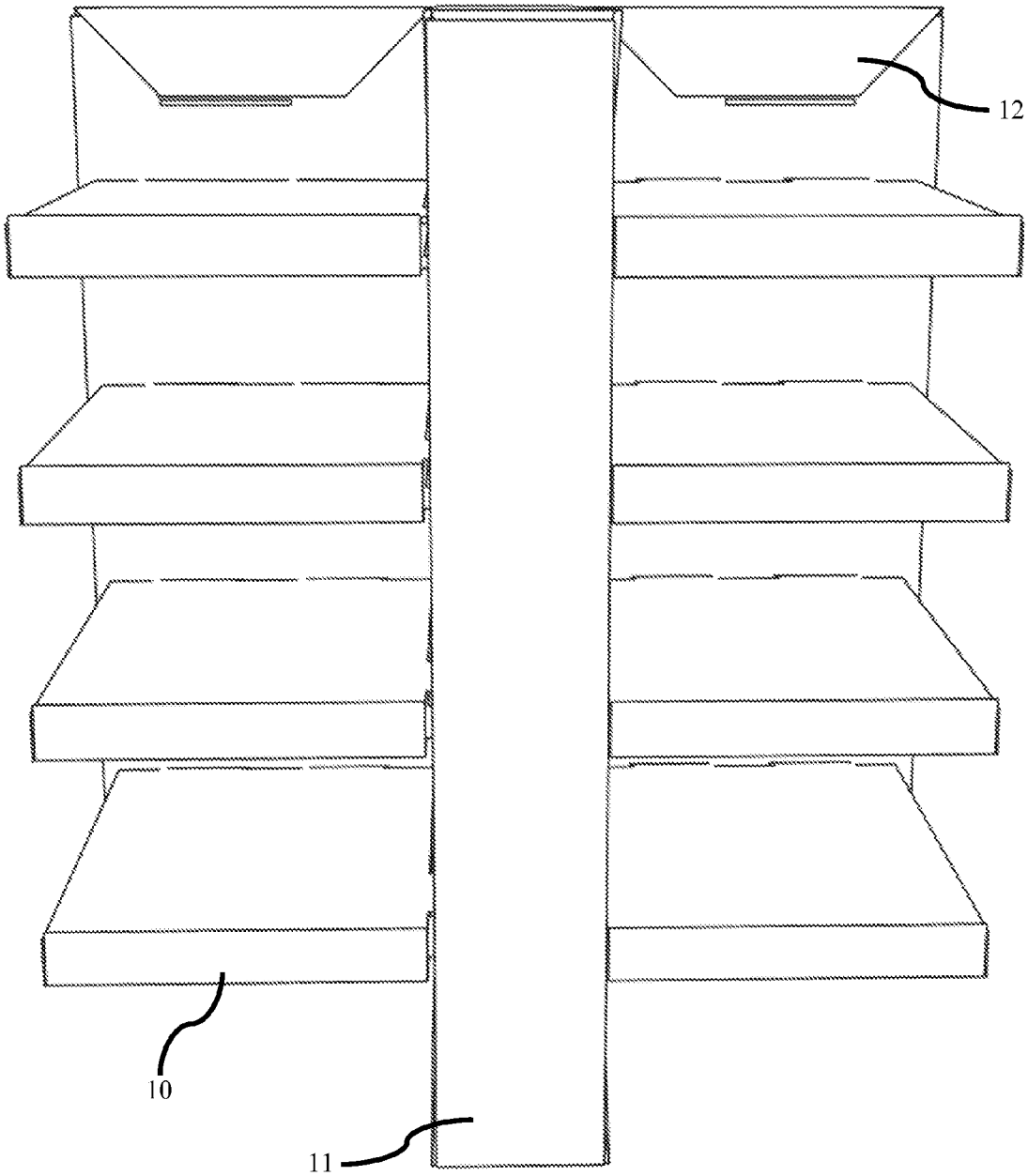
FIG. 2 is a perspective side view of a display shelving in accordance with exemplary embodiments of the present invention.

FIG. 2 is a perspective side view of a display shelving in accordance with exemplary embodiments of the present invention. As can be seen from this illustration, the floating shelves 10 may be arranged between each pair of proximate walls of the crossed core 11. A plurality of floating shelves 10 may be arranged in each quadrant as defined by the crossed core 11 and the floating shelves 10 of a particular quadrant may be vertically arranged with space provided above each shelf 10 where products may be packed for shipment, display and sale. Each shelf may have one raised end, as shown, to prevent the products from falling off the shelves 10. The shelves 10 may additionally or alternatively include racks, cutouts, bins, etc. for holding the products in place during shipment and keeping them neatly arranged during display. As can be seen from the combination of FIGS. 1 and 2, the display shelving may be shoppable at four sides, which is to say, customers may be able to walk around the display shelving and select products therefrom from all four sides of the display shelving.

Figure 3:
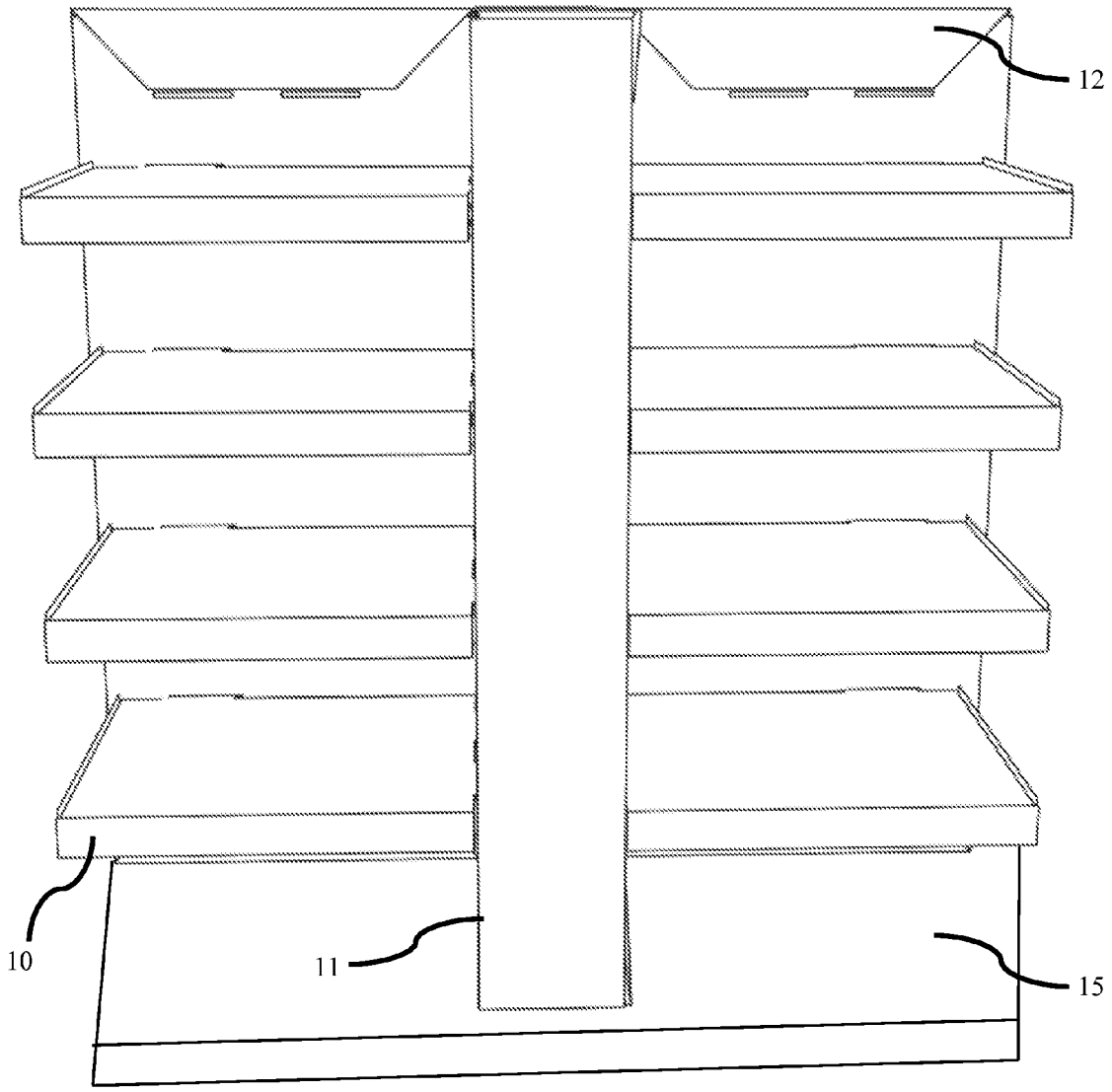
FIG. 3 is a perspective side view of a display shelving in accordance with exemplary embodiments of the present invention.

FIG. 3 is a perspective side view of a display shelving in accordance with exemplary embodiments of the present invention. As can be seen from this illustration, the shelves may have two raised sides to further prevent the products from falling off the shelves 10. The space between the base 15 and the first floating shelf 10 may also be packed with products. Although not shown, the base 15 may be disposed on a pallet for easy movement. For example, the base 15 may be disposed on a stack of two or more pallets and the pallets may be covered by s skirt member that is also made of cardboard.

Figure 4:
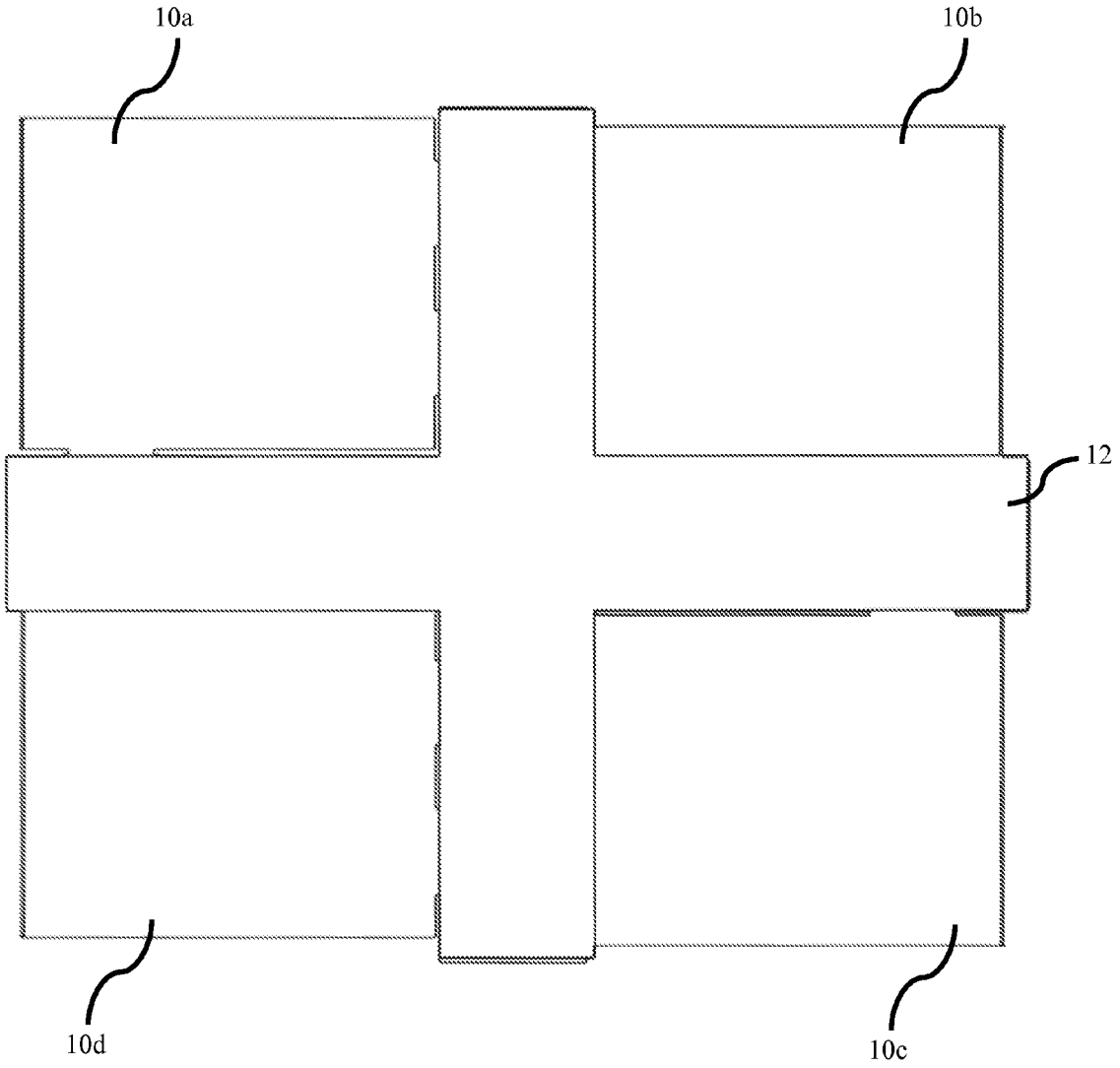
FIG. 4 is a top-down view of a display shelving in accordance with exemplary embodiments of the present invention.

FIG. 4 is a top-down view of a display shelving in accordance with exemplary embodiments of the present invention. The crossed core 11 is covered from view by the cap 12. Four floating shelves 10 (10*a*, 10*b*, 10*c*, and 10*d*) are disposed in each of the four quadrants of the crossed core 11. While only four floating shelves 10 are visible in this view, exemplary embodiments of the present invention may include a stack of floating shelves 10 vertically disposed in each quadrant as illustrated in FIGS. 1-3.

Figure 5:
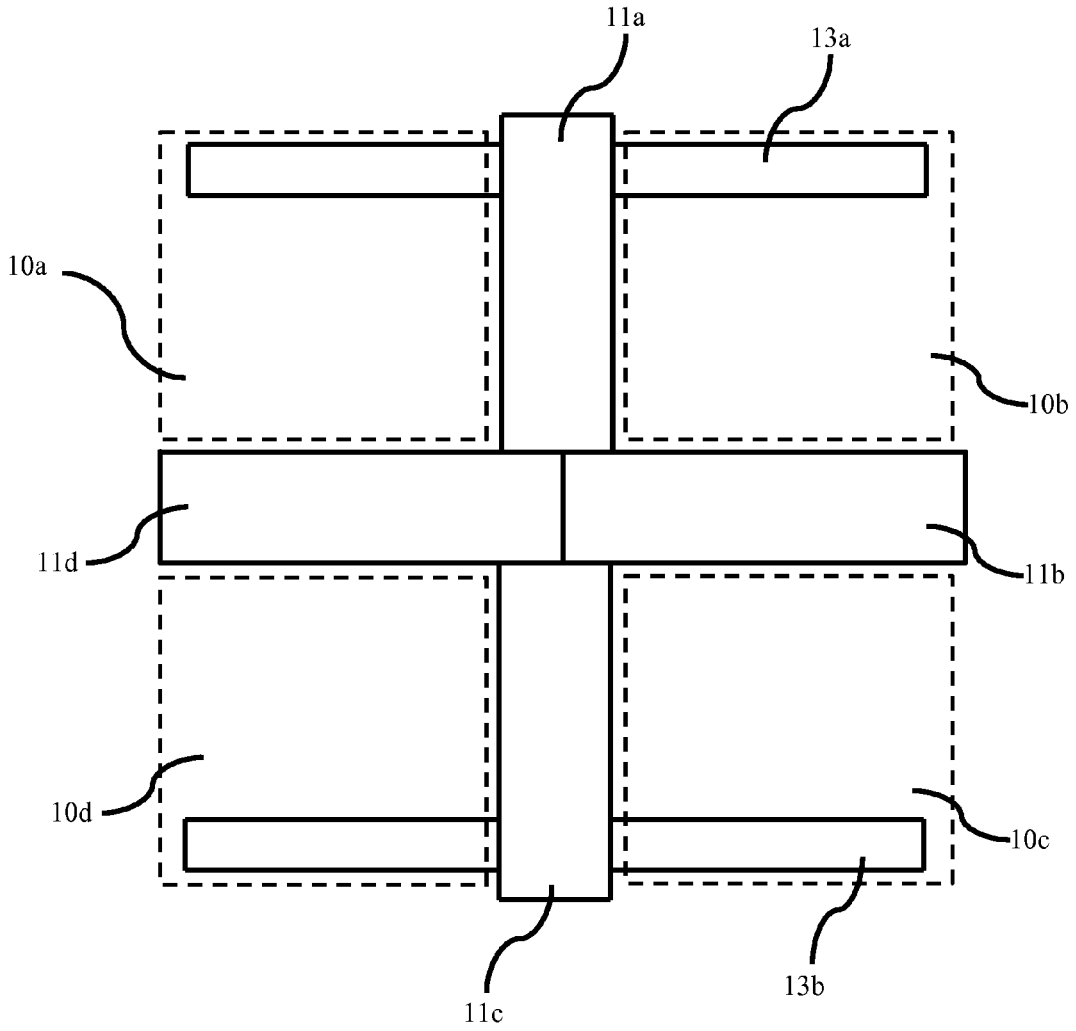
FIG. 5 is a cutaway view illustrating a display shelving in accordance with exemplary embodiments of the present invention.

FIG. 5 is a cutaway view illustrating a display shelving in accordance with exemplary embodiments of the present invention. In this view, the cap 12 is not visible. Instead, each of the four walls of the crossed core 11 may be seen. Two walls, 11*b* and 11*d*, are disposed at 180° from each other. These two walls may touch each other end to end, as shown. The walls may be formed from substantially flat cardboard that has been folded into boxes and joined with interlocking flaps and/or adhesive. The two walls may similarly be coupled to one another using interlocking flaps and/or adhesive.

Two additional walls, 11*a* and 11*c*, are disposed at 180° from each other. These two additional walls may also be formed from substantially flat cardboard that has been folded into boxes and joined with interlocking flaps and/or adhesive.

The two additional walls may similarly be coupled to the first set of walls using interlocking flaps and/or adhesive. Upon assembly, wall 11*a* may meet wall 11*b* at a right angle, wall 11*b* may meet wall 11*c* at a right angle, wall 11*c* may meet wall 11*d* at a right angle, and wall 11*d* may meet wall 11*a* at a right angle and the four quadrants may be accordingly defined.

The four walls 11*a*-11*d* need not necessarily meet in the arrangement shown. For example, one wall may be longer than the other three and each of the other three may be disposed around the one longer wall. In either event, four rectangular quadrants may be defined. Two of the four walls, for example, opposing walls such as walls 11*a* and 11*c*, may be threaded with support tubes 13. For example, wall 11*a* may be threaded with a first support tube 13*a* and wall 11*c* may be threaded with a second support tube 13*b*. The support tubes 13 may also be formed as a box from substantially flat cardboard. The support tubes may be threaded through holes arranged in the walls wherein the holes are just large enough to allow the support tubes 13 to pass therethrough and just tight enough to hold the support tubes 13 in place.

While only two support tubes 13 are visible from this perspective, exemplary embodiments of the present invention may have a plurality of support tubes aligned vertically and directly below the support tubes shown. Floating shelves 10 may be formed from substantially flat cardboard that has been folded into a box shape. An open end of the shelf 10 (or a hole in the shelf 10) may be received the support tube such that the support tube is fully enclosed within the shelf 10 or the crossed core 11 walls. The shelves may similarly be attached to the crossed core 11 walls by interlocking flaps and/or adhesive. In the arrangement shown, a first shelf 10*a* and a second shelf 10*b* both receive the same support tube 13*a* while the third shelf 10*c* and the fourth shelf 10*d* both receive the same support tube 13*b*. As discussed above, there may be multiple shelves and multiple support tubes vertically arranged in each quadrant. The shelves 10 are illustrated herein with dotted lines to show that they exist around the support tubes 13, for example a top surface of the shelf is disposed above the support tube while a bottom surface of the shelf is disposed below the support tube.

Figure 6:
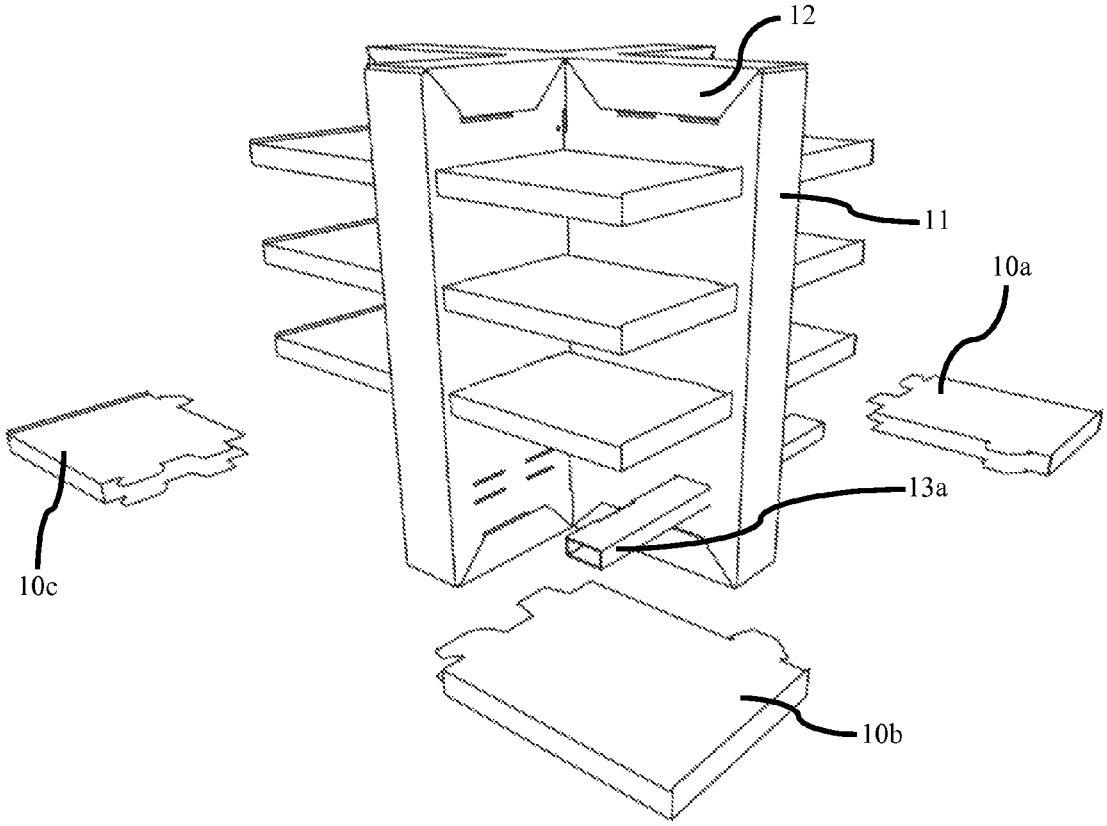
FIG. 6 is an exploded perspective view illustrating a display shelving in accordance with exemplary embodiments of the present invention.

FIG. 6 is an exploded perspective view illustrating a display shelving in accordance with exemplary embodiments of the present invention. As can be seen from this view, the shelves 10 may interlock with the walls of the crossed core 11 such that the support tubes 13 are disposed within the shelves 10.

Figure 7:
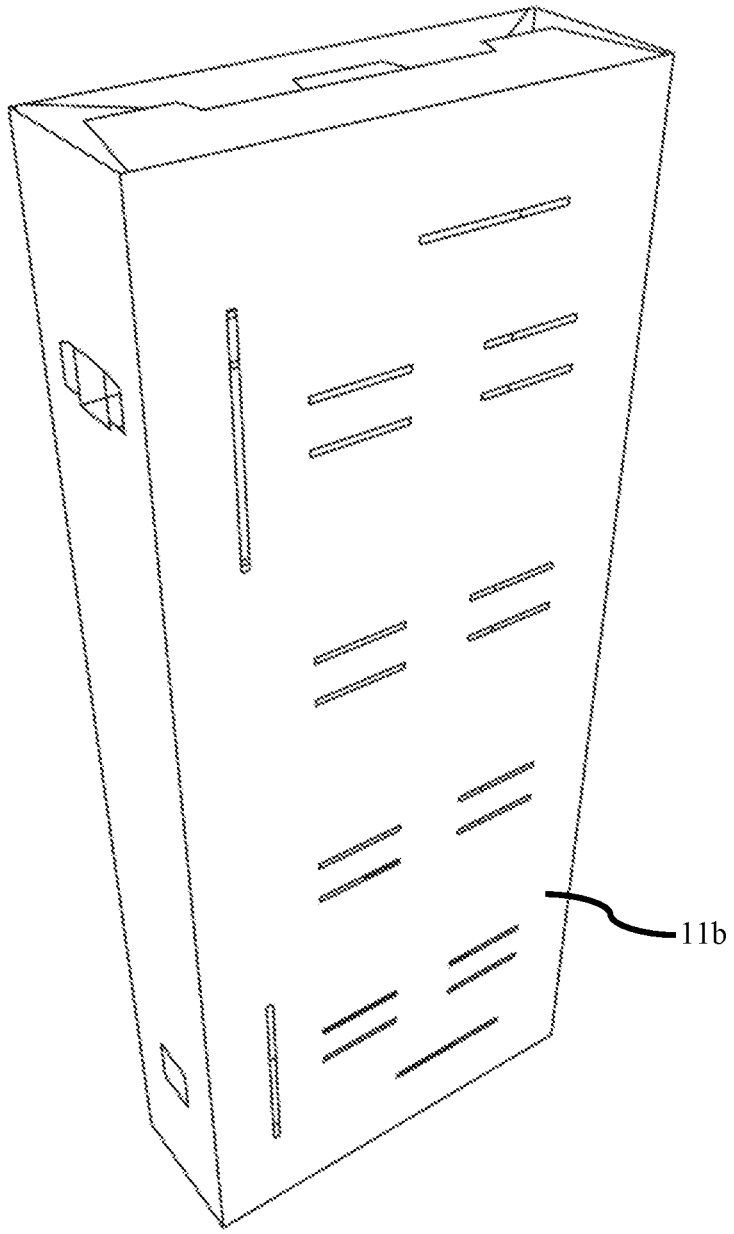
FIG. 7 is a perspective view of a wall of the crossed core in accordance with exemplary embodiments of the present invention.

FIG. 7 is a perspective view of a wall 11*b* of the crossed core in accordance with exemplary embodiments of the present invention. Slots for receiving tabs of the shelves can be seen. This figure illustrates a first step in the assembly of the display shelving.

Figure 8:
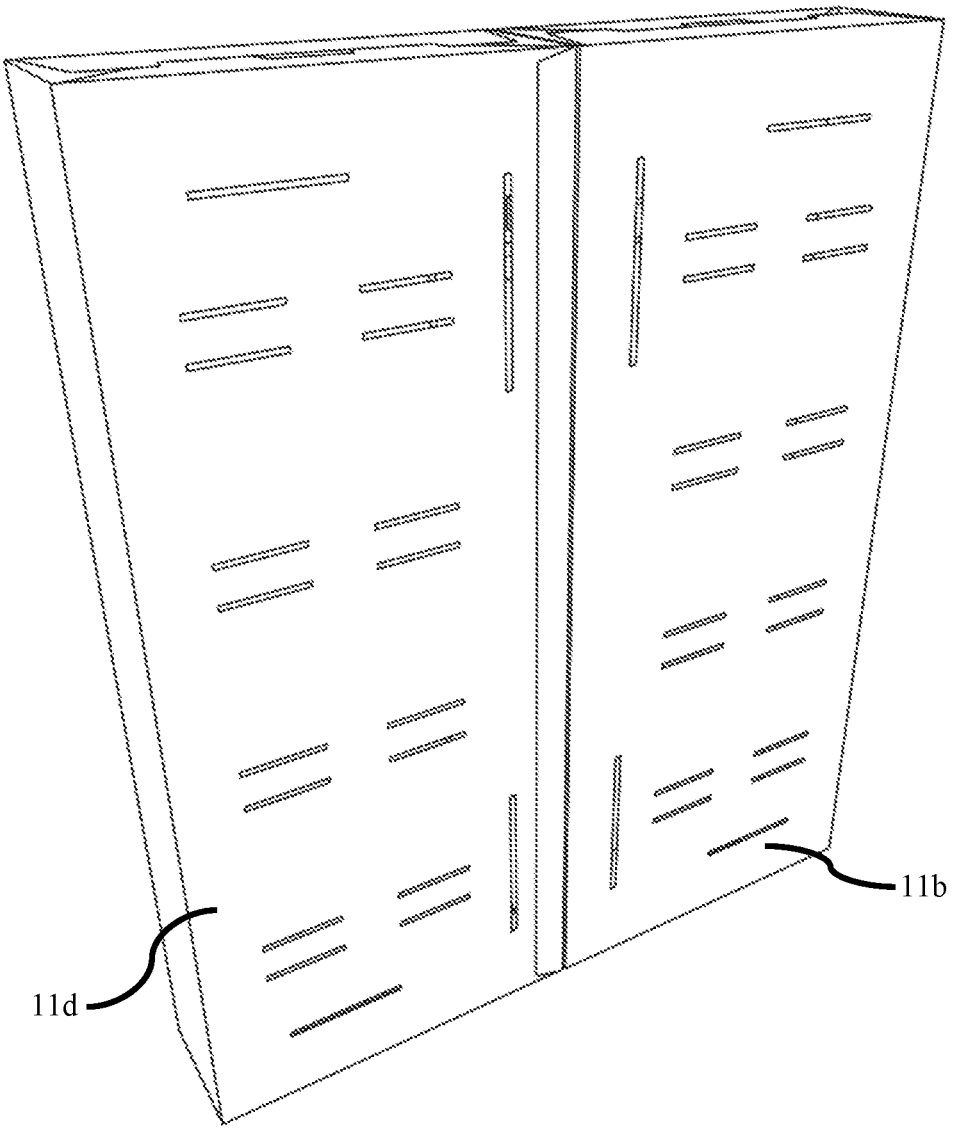
FIG. 8 is a perspective view of two walls of the crossed core in accordance with exemplary embodiments of the present invention

FIG. 8 is a perspective view of two walls 11*b* and 11*d* of the crossed core in accordance with exemplary embodiments of the present invention. Slots for receiving tabs of the shelves can be seen, as can the manner in which the walls come together. This figure illustrates a second step in the assembly of the display shelving.

Figure 9:
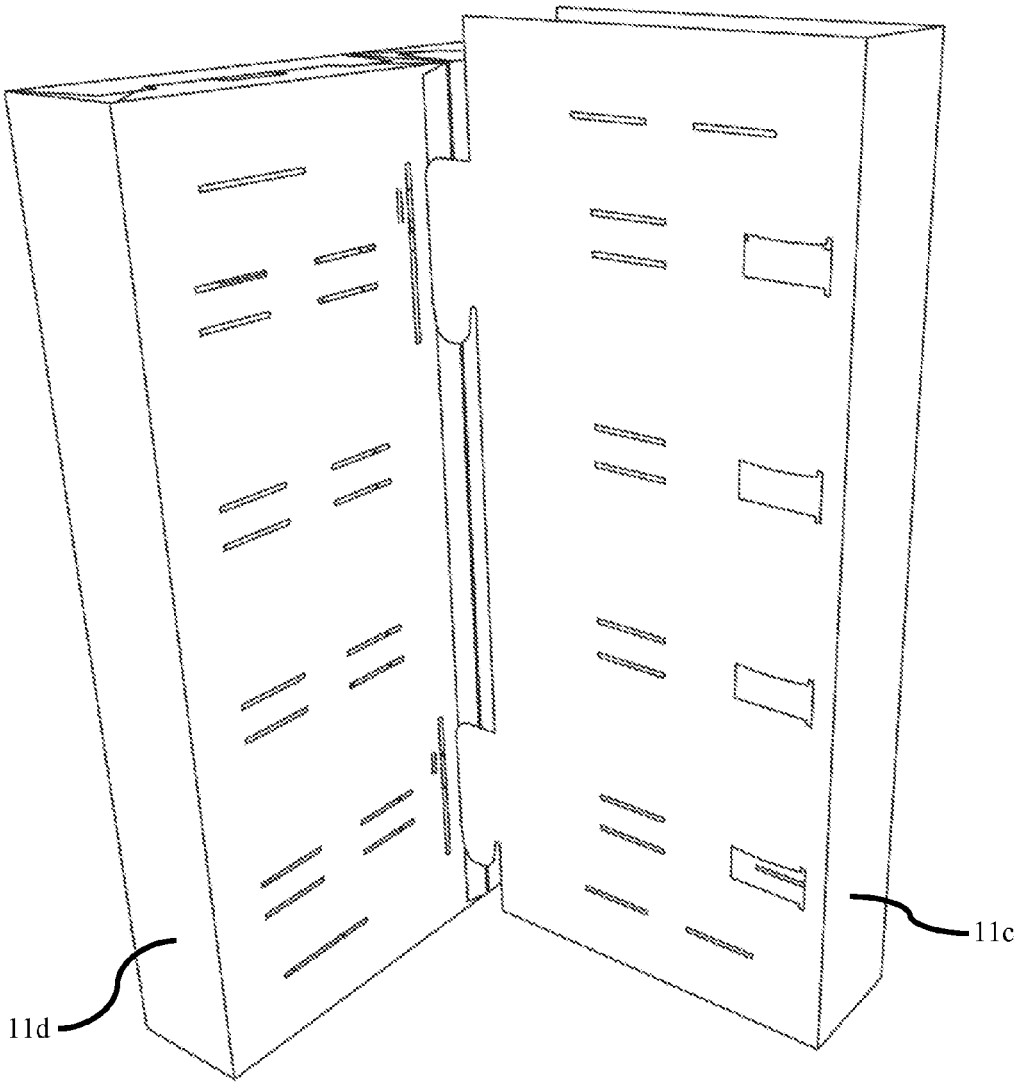
FIG. 9 is a perspective view of two walls of the crossed core in accordance with exemplary embodiments of the present invention.

FIG. 9 is a perspective view of two walls 11*c* and 11*d* of the crossed core in accordance with exemplary embodiments of the present invention. Slots for receiving tabs of the shelves can be seen, as can the manner in which the walls come together. This figure also shows holes for receiving the support tubes within opposing walls. This figure illustrates a third step in the assembly of the display shelving.

Figure 10:
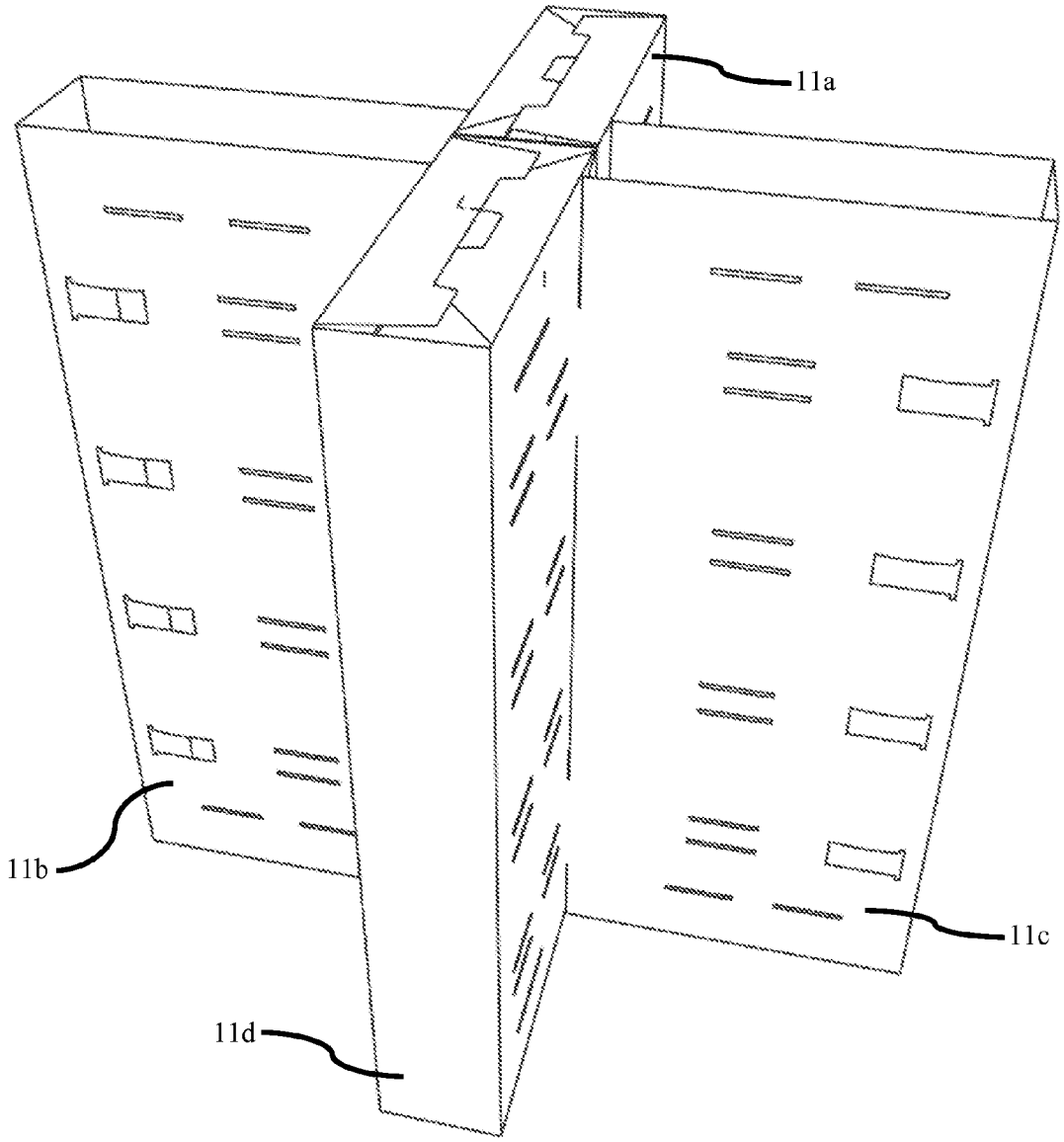
FIG. 10 is a perspective view of all four walls of the crossed core in accordance with exemplary embodiments of the present invention.

FIG. 10 is a perspective view of all four walls 11*a*, 11*b*, 11*c*, and 11*d* of the crossed core in accordance with exemplary embodiments of the present invention. Slots for receiving tabs of the shelves can be seen, as can the manner in which the walls come together. This figure also shows holes for receiving the support tubes within opposing walls. This figure illustrates a fourth step in the assembly of the display shelving.

Figure 11:
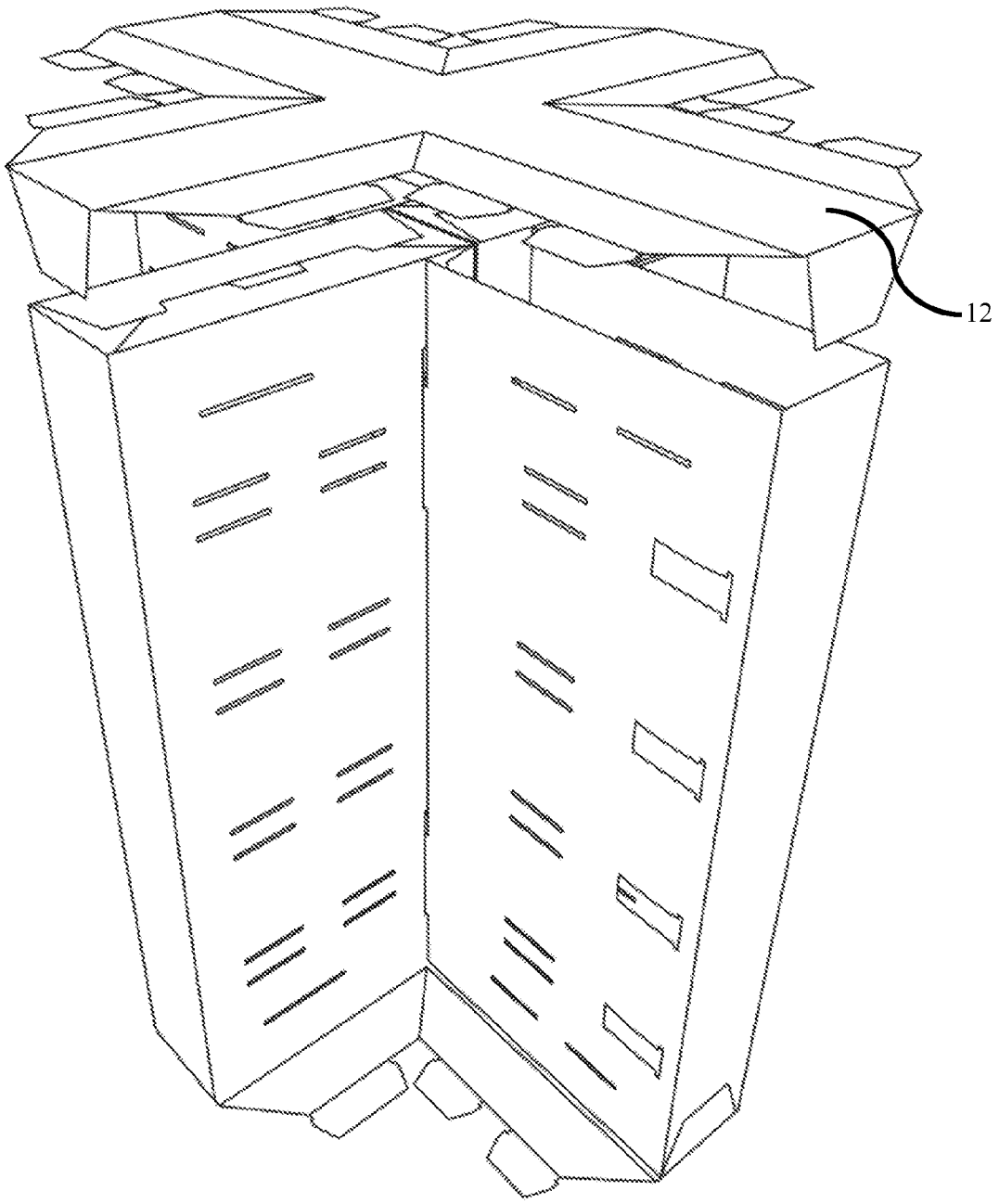
FIG. 11 is an exploded perspective view showing an arrangement of the cap on the crossed core in accordance with exemplary embodiments of the present invention.

FIG. 11 is an exploded perspective view showing an arrangement of the cap 12 on the crossed core in accordance with exemplary embodiments of the present invention. This figure illustrates a fifth step in the assembly of the display shelving.

Figure 12:
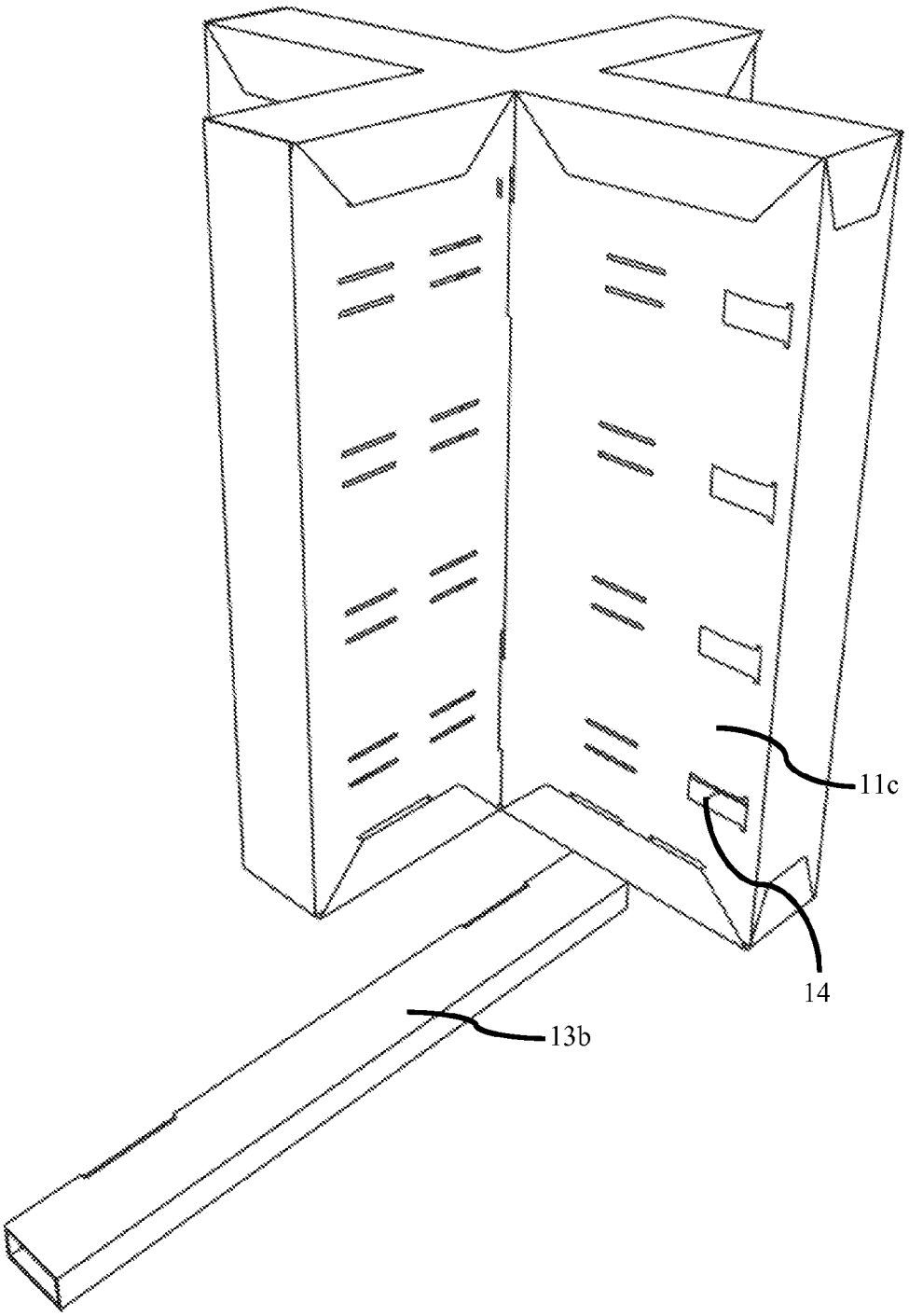
FIG. 12 is an exploded perspective view showing the disposition of the support tube and showing a receiving hole within the wall of the crossed core in accordance with exemplary embodiments of the present invention.

FIG. 12 is an exploded perspective view showing the disposition of the support tube 13 and showing a receiving hole 14 within the wall 11*c* of the crossed core in accordance with exemplary embodiments of the present invention. This figure illustrates a sixth step in the assembly of the display shelving.

Figure 13:
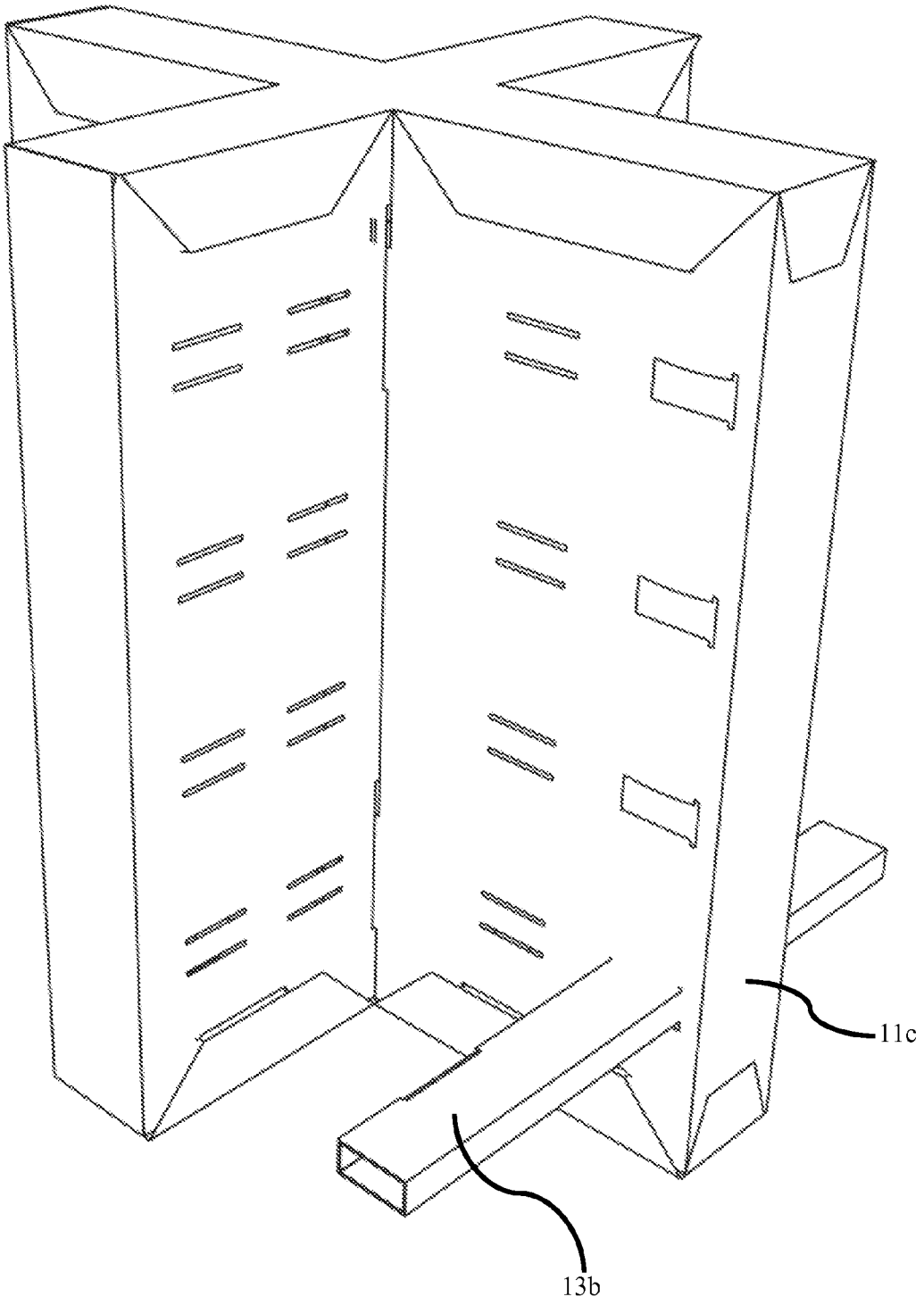
FIG. 13 is an exploded perspective view showing the insertion of the support tube into a receiving hole within the wall of the crossed core in accordance with exemplary embodiments of the present invention.

FIG. 13 is an exploded perspective view showing the insertion of the support tube 13 into a receiving hole 14 within the wall 11*c* of the crossed core in accordance with exemplary embodiments of the present invention. This figure illustrates a seventh step in the assembly of the display shelving.

Figure 14:
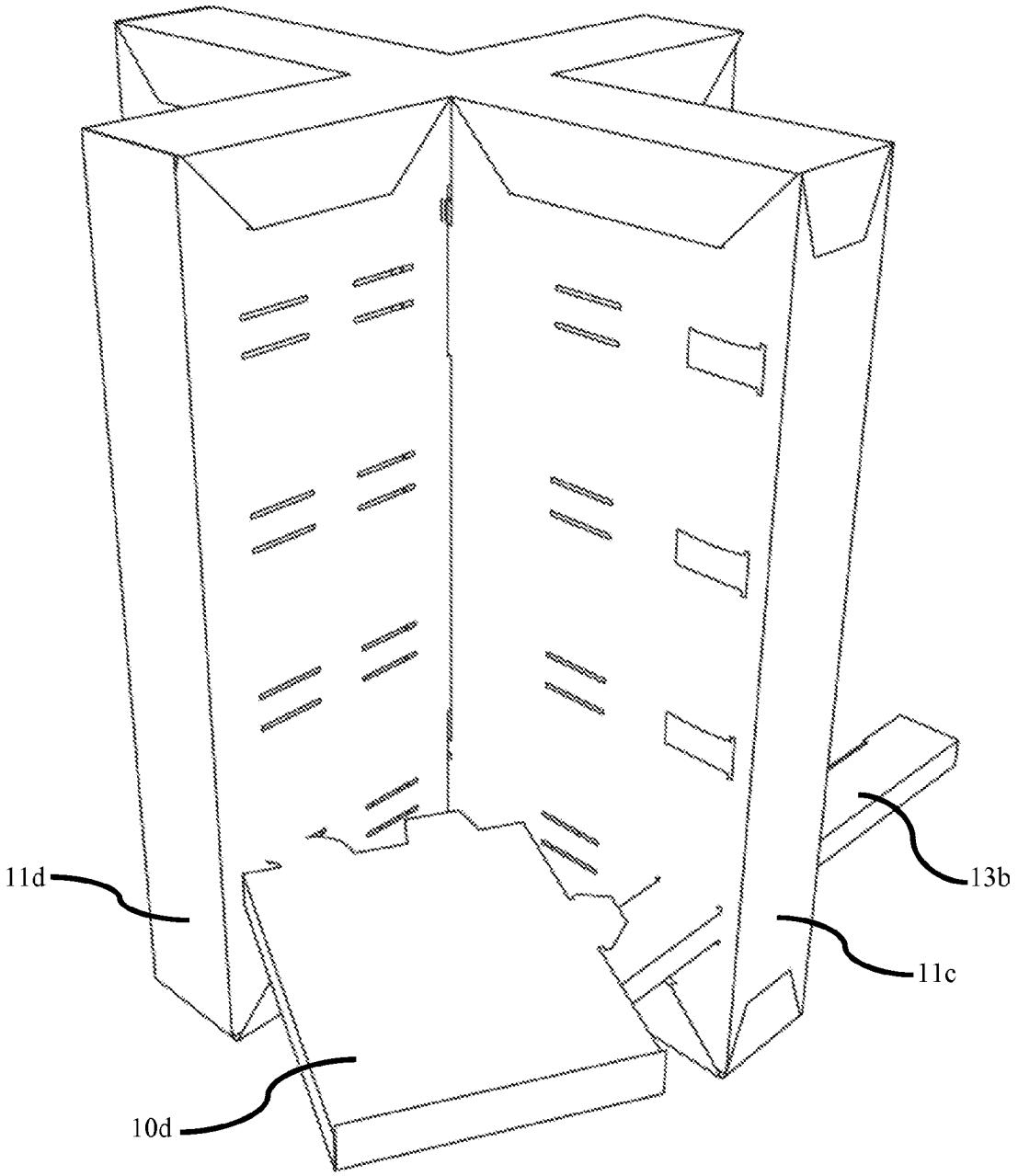
FIG. 14 is an exploded perspective view showing the insertion of the floating shelf into place between two walls and that meet at right angles in accordance with exemplary embodiments of the present invention.

FIG. 14 is an exploded perspective view showing the insertion of the floating shelf 10*d* into place between two walls 11*d* and 11*c* that meet at right angles in accordance with exemplary embodiments of the present invention. As illustrated, the floating shelf 10*d* is inserted into place over the support tube 13*b* and the floating shelf engages with the walls 11*d* and 11*c* with interlocking tabes and slits. This figure illustrates an eighth step in the assembly of the display shelving.

Figure 15:
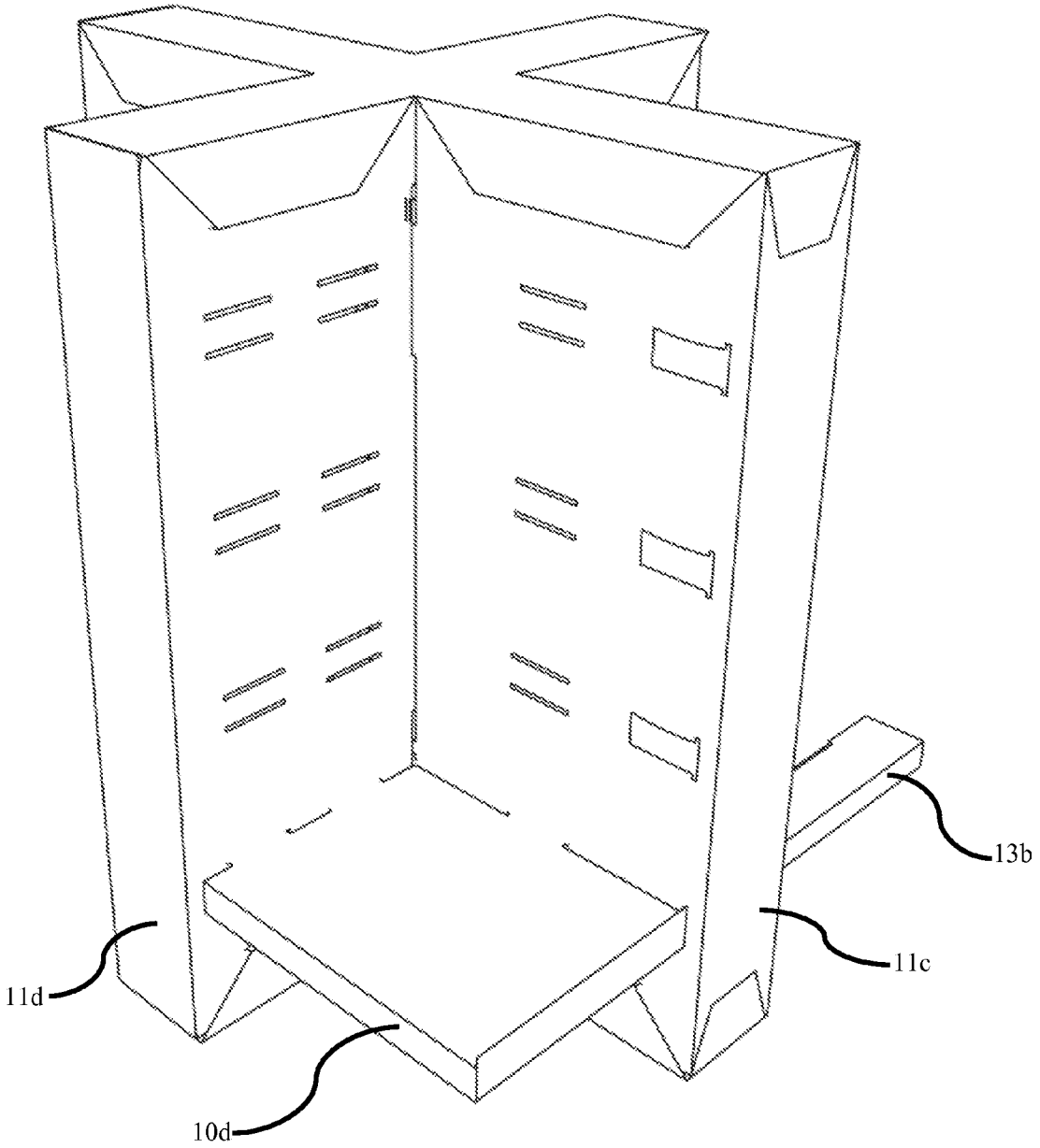
FIG. 15 is a perspective view illustrating a disposition of the floating shelf into place between two walls and that meet at right angles in accordance with exemplary embodiments of the present invention.

FIG. 15 is a perspective view illustrating a disposition of the floating shelf 10*d* into place between two walls 11*d* and 11*c* that meet at right angles in accordance with exemplary embodiments of the present invention. This figure illustrates a ninth step in the assembly of the display shelving.

Figure 16:
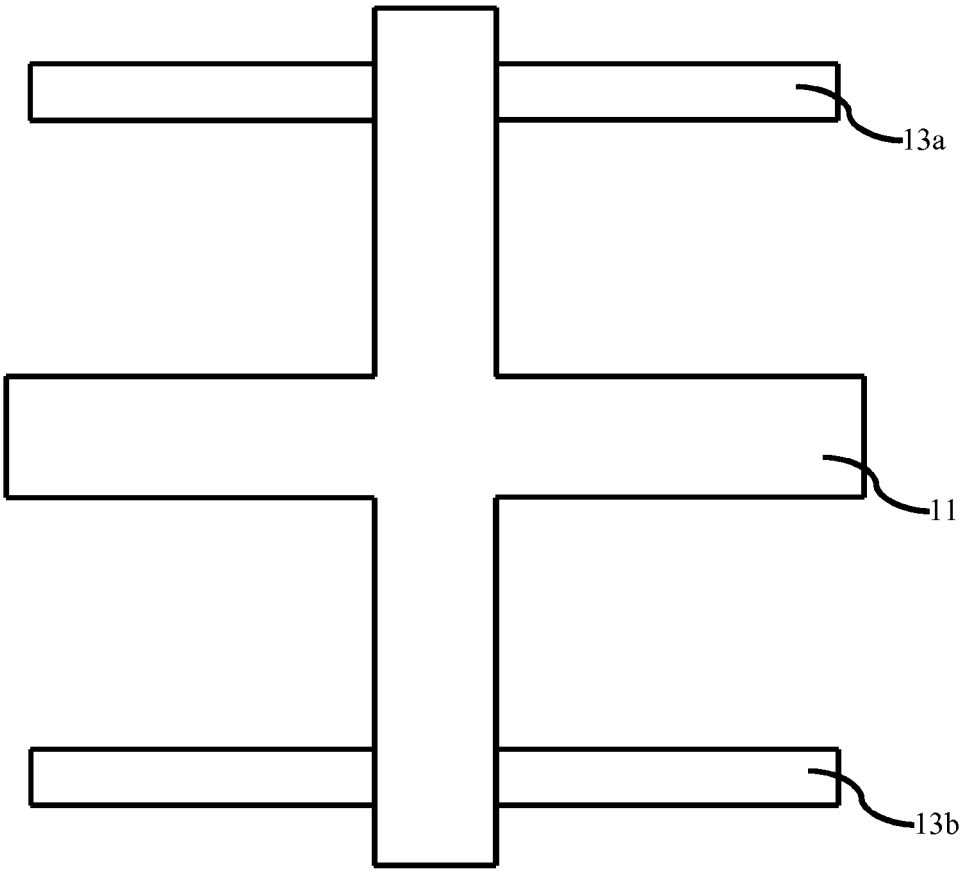
FIG. 16 is a schematic diagram illustrating an arrangement of two support tubes and into the crossed core in accordance with exemplary embodiments of the present invention.

FIG. 16 is a schematic diagram illustrating an arrangement of two support tubes 13*a* and 13*b* into the crossed core in accordance with exemplary embodiments of the present invention. As can be seen, the support tubes may be inserted into just two opposing walls of the four walls of the crossed core so that each shelf has just one support tube disposed therein. As each supporting tube supports two shelves, each shelf may act as counterweight against the other.

Figure 17:
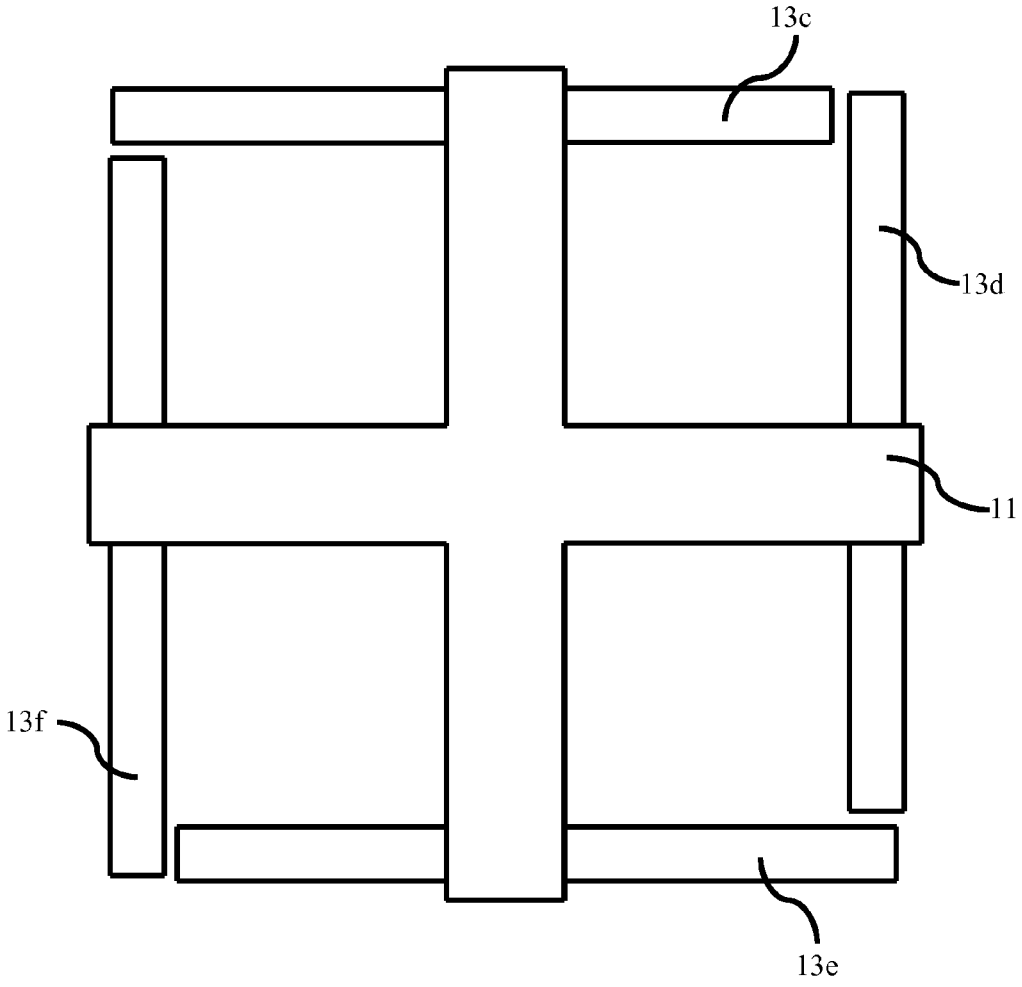
FIG. 17 is a schematic diagram illustrating an arrangement of four support tubes into the crossed core in accordance with exemplary embodiments of the present invention.

FIG. 17 is a schematic diagram illustrating an arrangement of four support tubes 13*c*, 13*d*, 13*e*, and 13*f* into the crossed core in accordance with exemplary embodiments of the present invention. As can be seen, the support tubes may be inserted into each of the four walls of the crossed core so that each shelf has two support tubes disposed therein. However, even in this arrangement, each supporting tube still supports two shelves, and each shelf may act as counterweight against the other. In the arrangement shown, all supporting tubes are of equal length and are arranged in a pinwheel pattern.

Figure 18:
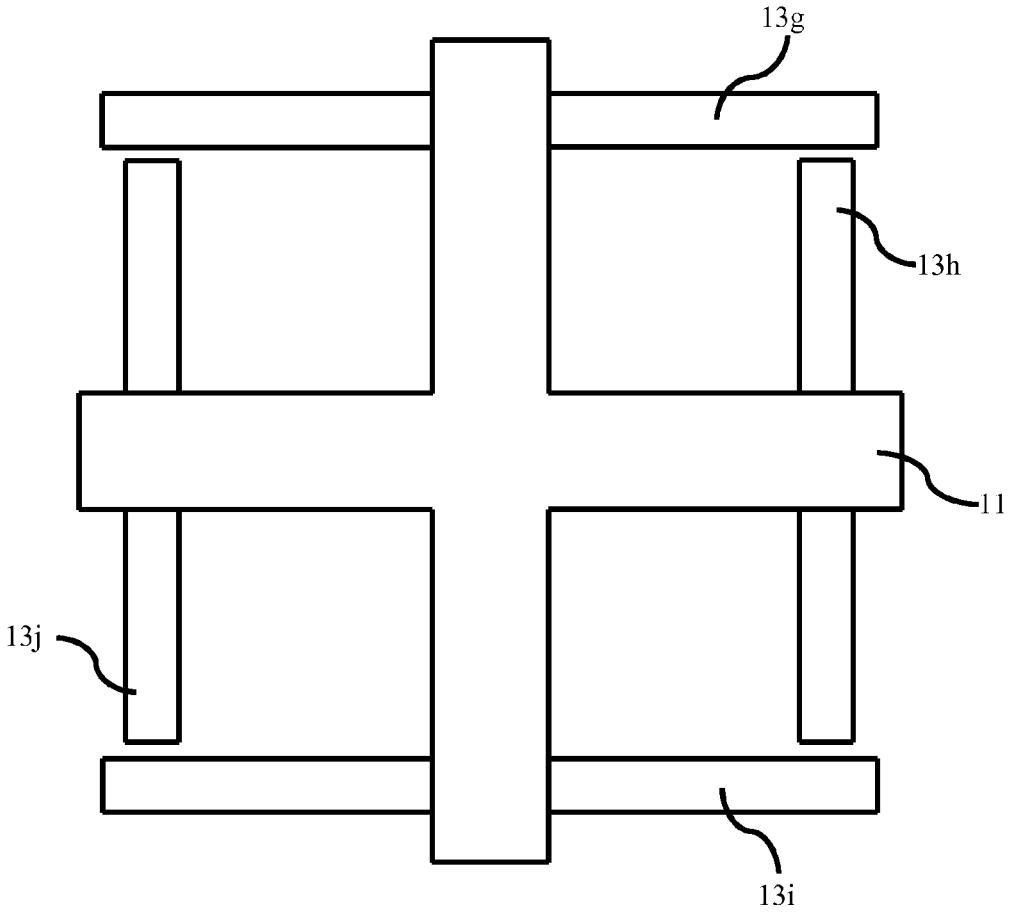
FIG. 18 is a schematic diagram illustrating an alternative arrangement of four support tubes into the crossed core in accordance with exemplary embodiments of the present invention.

FIG. 18 is a schematic diagram illustrating an alternative arrangement of four support tubes 13*g*, 13*h*, 13*i*, and 13*j* into the crossed core in accordance with exemplary embodiments of the present invention. As can be seen, the support tubes may be inserted into each of the four walls of the crossed core so that each shelf has two support tubes disposed therein. However, even in this arrangement, each supporting tube still supports two shelves, and each shelf may act as counterweight against the other. In the arrangement shown, two supporting tubes 13*g* and 13*i* are of a first length and two other supporting tubes 13*h* and 13*j* are of a second length shorter than the first length. Other arrangements not shown are possible and as the display shelf may have multiple layers of shelving arranged vertically, it is possible for each plane of shelves to use a different arrangement of supporting tubes. For example, some shelves which are configured to hold heavier products may utilize a four support tube configuration while other shelves which are configured to hold lighter products may utilize a two support tube configuration.

According to one exemplary embodiment of the present invention, lower planes of shelves may be configured to hold heavier products than higher planes of shelves and accordingly, the higher planes of shelves may utilize fewer support tubes per plane than the lower planes. According to one such arrangement, a plurality of planes of shelves are provided and each plane utilizes successively fewer support tubes than the plane below it. For example, there may be four planes of shelves provided with the top plane utilizing two support tubes, the second-from-top plane utilizing four support tubes, the second-from-bottom plane utilizing six support tubes, and the bottom plane utilizing eight support tubes.

Figure 19:
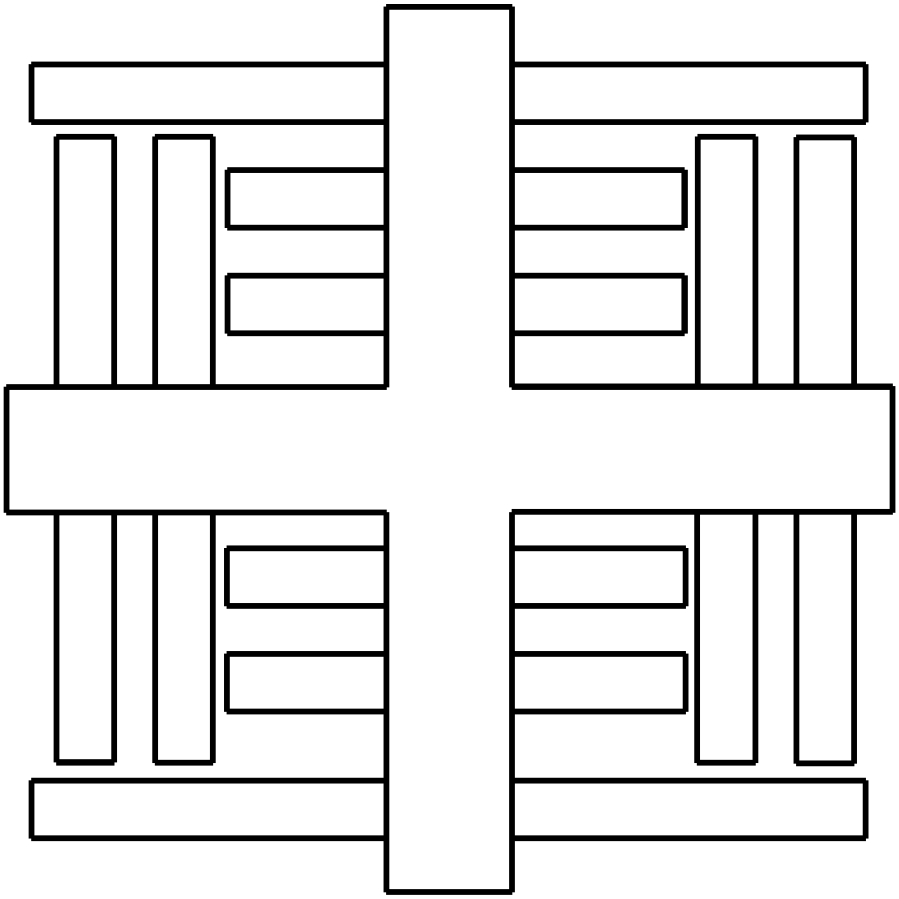
FIG. 19 is a schematic diagram illustrating an arrangement for ten support tubes in accordance with exemplary embodiments of the present invention.

Any number of support tubes may be so arranged provided that each tube supports opposing shelves. Accordingly, each support tube may still be threaded through a wall of the crossed core and support two shelves that act as opposing forces with respect to each other. FIG. 19 is a schematic diagram illustrating an arrangement for ten support tubes in accordance with exemplary embodiments of the present invention. As shown here, there may be multiple support tubes crossing through a single wall to support the same set of matched shelves. However, this need not be the case. The support tubes may be arranged in a spiral-like pattern so that some support tubes of a given plane support first and second quadrants while other support tubes of the given plane support second and third quadrants while still other support tubes of the given plane support third and fourth quadrants while still other support tubes of the given plane support fourth and first quadrants, where the quadrants are numbered in a clockwise fashion.

Figure 20:
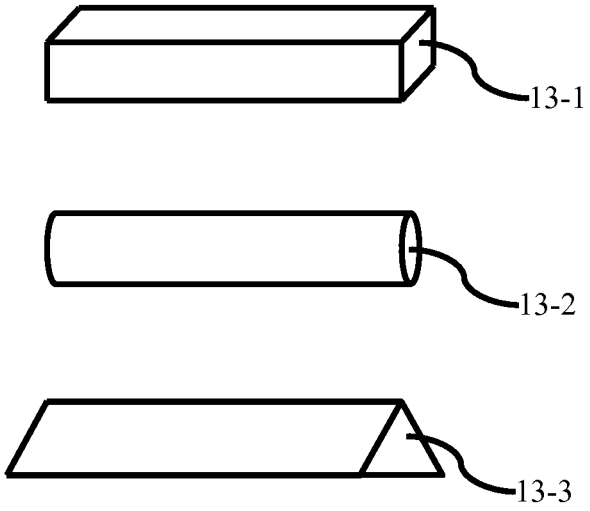
FIG. 20 is a schematic diagram illustrating various support tube geometries in accordance with exemplary embodiments of the present invention.

The support tubes need not be shaped as a rectangular box. FIG. 20 is a schematic diagram illustrating various support tube geometries in accordance with exemplary embodiments of the present invention. It is to be understood that the holes in the walls would be of a shape matching the cross section of the support tube. As shown, the support tube may be a rectangular prism or cuboid 13-1, a cylinder 13-2, a triangular prism 13-3 or any other parallelogram prism or parallelepiped shape. However, parallelogram prisms may be easier to fashion out of cardboard than cylinders while rectangular or square prisms may offer more structural support for the floating shelves.

Exemplary embodiments described herein are illustrative, and many variations can be introduced without departing from the spirit of the disclosure or from the scope of the appended claims. For example, elements and/or features of different exemplary embodiments may be combined with each other and/or substituted for each other within the scope of this disclosure and appended claims.

What is claimed is:

1. A shelving unit, comprising:

a crossed core unit comprising four walls each formed of folded corrugated fiberboard, the four walls orthogonally arranged with respect to each other and defining four quadrants therebetween;

a plurality of shelves with at least one of the plurality of shelves disposed in each quadrant, each of the plurality of shelves formed of folded corrugated fiberboard wherein each of the plurality of shelves is joined to two of the four walls of the crossed core unit; and a plurality of support tubes, each formed of folded corrugated fiberboard and each disposed through one wall of the crossed core unit and extending inside of two shelves of the plurality of shelves, wherein each of the plurality of shelves appear to float since they are supported by the support tubes that are hidden inside of the shelves.

2. The shelving unit of claim 1, wherein the crossed core unit is disposed on a base unit formed of folded corrugated fiberboard, the base unit being a rectangular prism or cuboid in shape.

3. The shelving unit of claim 1, wherein a cap unit formed of a single sheet of corrugated fiberboard is disposed on top of the crossed core unit, wherein the cap unit is substantially cross-shaped.

4. The shelving unit of claim 1, wherein the plurality of shelves are arranged in at least one plane.

5. The shelving unit of claim 4, wherein the at least one plane includes at least two planes and each of the at least two planes includes four shelves of the plurality of shelves.

6. The shelving unit of claim 1, wherein each of the plurality of shelves is joined to the two of the four walls of the crossed core unit using an adhesive or tabs and slits.

7. The shelving unit of claim 1, wherein each of the plurality of support tubes is disposed through the one wall of the crossed core unit through a hole formed in the one wall of the crossed core unit.

8. The shelving unit of claim 1, wherein each of the plurality of support tubes has a shape of a rectangular prism or cuboid.

9. A shelving unit, comprising:

a crossed core unit comprising a first wall formed of folded corrugated fiberboard, a second wall formed of folded corrugated fiberboard extending at a right angle with respect to the first wall, a third wall formed of folded corrugated fiberboard extending at a right angle with respect to the second wall, and a fourth wall formed of folded corrugated fiberboard extending at a right angle with respect to the third wall;

a first shelf formed of folded corrugated fiberboard and disposed between the first and second wall, a second shelf formed of folded corrugated fiberboard and disposed between the second and third wall, a third shelf formed of folded corrugated fiberboard and disposed between the third and fourth wall, and a fourth shelf formed of folded corrugated fiberboard and disposed between the fourth and first wall, wherein each of the first, second, third and fourth shelves are disposed within a first plane; and a first support tube formed of folded corrugated fiberboard disposed through a first hole in the first wall and extending inside of the first and fourth shelves, and a second support tube formed of folded corrugated fiberboard disposed through a first hole in the third wall and extending inside of the second and third shelves, wherein the first and fourth shelves each appear to float since they are supported by the first support tube that is hidden inside of the first and fourth shelves, and wherein the second and third shelves each appear to float since they are supported by the second support tube that is hidden inside of the second and third shelves.

10. The shelving unit of claim 9, additionally comprising a third support tube formed of folded corrugated fiberboard disposed through a first hole in the second wall and extending inside of the first and second shelves, and a fourth support tube formed of folded corrugated fiberboard disposed through a first hole in the fourth wall and extending inside of the third and fourth shelves.

11. The shelving unit of claim 9, additionally comprising:

a fifth shelf formed of folded corrugated fiberboard and disposed between the first and second wall, a sixth shelf formed of folded corrugated fiberboard and disposed between the second and third wall, a seventh shelf formed of folded corrugated fiberboard and disposed between the third and fourth wall, and an eighth shelf formed of folded corrugated fiberboard and disposed between the fourth and first wall, wherein each of the fifth, sixth, seventh and eighth shelves are disposed within a second plane; and a third support tube formed of folded corrugated fiberboard disposed through a second hole in the first wall and extending inside of the fifth and sixth shelves, and a fourth support tube formed of folded corrugated fiberboard disposed through a second hole in the third wall and extending inside of the sixth and seventh shelves.

12. The shelving unit of claim 9, wherein the first and third walls are arranged end-to-end with respect to each other and the second and fourth walls are each arranged to meet both the first and third walls.

13. The shelving unit of claim 9, wherein a cap unit formed of a single sheet of corrugated fiberboard covers tops of the first, second, third, and fourth walls.

14. The shelving unit of claim 9, wherein each of the first and second support tubes has a shape of a rectangular prism or cuboid.

15. A method for transporting and displaying products, comprising:

assembling a shelving unit, comprising:

a crossed core unit comprising four walls formed of folded corrugated fiberboard, the four walls orthogonally arranged with respect to each other and defining four quadrants therebetween;

a plurality of shelves with at least one of the plurality of shelves disposed in each quadrant, each of the plurality of shelves formed of folded corrugated fiberboard wherein each of the plurality of shelves is joined to two of the four walls of the crossed core unit; and a plurality of support tubes, each formed of folded corrugated fiberboard and each disposed through one wall of the crossed core unit and extending inside of two shelves of the plurality of shelves;

arranging a plurality of products on the plurality of shelves; and shipping the shelving unit with products arranged therein to a retail showroom for display of the plurality of products within the shelving unit.

16. The method of claim 15, wherein assembling the shelving unit includes joining the plurality of shelves to the two of the four walls of the crossed core unit using tabs and slits or an adhesive.

* * * * *